US009040002B2

(12) United States Patent
Yu et al.

(10) Patent No.: US 9,040,002 B2
(45) Date of Patent: May 26, 2015

(54) MICROTITER PLATE MASK

(75) Inventors: Xiang Yu, Germantown, MD (US); Timothy Fisher Steppe, Severna Park, MD (US); Samuel J. Rulli, Jr., Frederick, LA (US); Jingping Yang, Gaithersburg, MD (US); Mark S. Berninger, Gaithersburg, MD (US)

(73) Assignee: Qiagen Sciences LLC, Germantown, MD (US)

( * ) Notice: Subject to any disclaimer, the term of this patent is extended or adjusted under 35 U.S.C. 154(b) by 544 days.

(21) Appl. No.: 12/650,247

(22) Filed: Dec. 30, 2009

(65) Prior Publication Data

US 2010/0190170 A1 Jul. 29, 2010

Related U.S. Application Data

(60) Provisional application No. 61/204,181, filed on Dec. 31, 2008.

(51) Int. Cl.
*B01L 99/00* (2010.01)
*B01L 3/00* (2006.01)

(52) U.S. Cl.
CPC ..... *B01L 3/50853* (2013.01); *B01L 2200/021* (2013.01); *B01L 2200/025* (2013.01); *B01L 2200/141* (2013.01); *B01L 2300/021* (2013.01); *B01L 2300/044* (2013.01); *B01L 2300/0829* (2013.01); *B01L 2300/123* (2013.01)

(58) Field of Classification Search
CPC ..... C12Q 1/686; C12Q 2561/113; B01L 2200/021; B01L 2200/025; B01L 2200/141; B01L 2300/021; B01L 2300/044; B01L 2300/0829; B01L 2300/123; B01L 3/50853
USPC ..... 422/407, 552, 569
See application file for complete search history.

(56) References Cited

U.S. PATENT DOCUMENTS 4,284,725 A * 8/1981 Fennel et al. ..... 435/288.4
4,919,894 A 4/1990 Daniel (Continued)

FOREIGN PATENT DOCUMENTS

EP 0118275 9/1984
WO 98/39475 9/1998

OTHER PUBLICATIONS

International Search Report and Written Opinion, Mar. 4, 2010.
Koltay, et al., The Dispensing Well Plate: a Novel Nanodispenser for the Multiparallel Delivery of Liquids (DWP Part I), Sensors and Actuators A, 2004, pp. 483-491, 116, Elsevier B.V.

(Continued)

*Primary Examiner* — Dean Kwak
(74) *Attorney, Agent, or Firm* — Lathrop & Gage LLP

(57) ABSTRACT

Provided is a masking system of masks for use with multiwell plates such as microtiter plates to facilitate sample dispensing and assay accuracy, especially when dispensing more than one solution into the wells. One or more masks, adapted in size to fit snugly over a multiwell plate and the mask formed with openings each aligned with a subset of one or more wells of the plate beneath, aids the user in sample and/or reagent administration. Advantageously, the masks contain registration aids so that proper orientation with respect to the plate below is achieved; the registration aid may be a cut corner, registration peg or mark, or visual marking or stamping.

14 Claims, 5 Drawing Sheets

(56) References Cited

U.S. PATENT DOCUMENTS

| | | | | |
|---|---|---|---|---|
| 4,925,629 | A | 5/1990 | Schramm | |
| 5,290,521 | A | 3/1994 | DeStefano, Jr. | |
| 6,500,390 | B1 | 12/2002 | Boulton et al. | |
| 7,597,854 | B1 | 10/2009 | Reynolds | |
| 2002/0172621 | A1* | 11/2002 | Barbera-Guillem | 422/100 |
| 2003/0008412 | A1 | 1/2003 | Coffman et al. | |
| 2003/0032048 | A1 | 2/2003 | Kim et al. | |
| 2004/0009101 | A1 | 1/2004 | Suzuki et al. | |
| 2004/0266023 | A1* | 12/2004 | Clark et al. | 436/180 |
| 2005/0013743 | A1 | 1/2005 | Farina et al. | |
| 2007/0003448 | A1 | 1/2007 | Kanigan et al. | |
| 2007/0009394 | A1 | 1/2007 | Bean | |

OTHER PUBLICATIONS

LightOne Illuminator FS, Brochure, Embi Tec., Apr. 24, 2009.
LightOne Illuminator FS, Instruction Manual Vers. 1.0, Embi Tec.
Well Aware-Bio TX, Brochure, 2 pages, undated.
Well Aware-Bio TX, PCR Brochure, 2 pages, undated.
Well Mark-Stovall, Brochure, 2 pages, undated.
Well Mark-Stovall, Manual, 4 pages, undated.
Well Match Guide Cover Set, 1 page, undated.
Well Match User Manual, 6 pages, May 2006.
EP Search Report, dated Nov. 22, 2012, corresponding to European Application No. 09837180.0, filed Dec. 30, 2009, corresponding foreign application, 6 pp.

* cited by examiner

MICROTITER PLATE MASK

CROSS-REFERENCE TO RELATED APPLICATIONS

This application claims the benefit of U.S. Provisional Application No. 61/204,181, filed Dec. 31, 2008, which application is incorporated by reference in its entirety to the extent there is no inconsistency with the present disclosure.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

The present invention relates to methods and devices for pipetting aliquots of material, for example, samples and reagents, into multiwell receptacles such as, but not limited to, microtiter plates, especially using a mask with openings or holes in which the openings are adapted to allow the particular additions to be made into the receptacle. These masks or covers also serve as masks that reveal only certain wells in the multiwall receptacle at a given time. Use of these masks reduces the risk that operator error will result in incorrect addition of reagents, thereby compromising the validity of assay results. While current embodiments relate to SBS standard microtiter plates, the invention may be applied to other multiwell receptacle formats currently in use or which may be developed.

Real-time PCR (qPCR) has become a standard method for determining the relative concentration of molecules for a specific nucleic acid sequence within a complex population of sequences from a biological sample. It is one of many state of the art instrumentation systems that utilize SBS microtiter plates. Microtiter plates, in 96-well and 384 well formats, have become the standard reaction vessel format for qPCR, with 96-well being most prevalent. The SBS format has become a standard for many other assays than qPCR, and many instrument and automated systems have been developed based on use of disposable components adapted to the SBS format. Other formats have been and could be used to array multiple wells in a moveable device. In particular, a multiwell receptacle in which the wells are arranged in a circle can be used in automated systems, the Rotor-Gene Q system being an example. Since a circular arrangement of wells is symmetrical around the center of the circle, addition of reagents to the wells is especially prone to mistakes by manual operators. The present invention can be adapted to these other multiwell receptacle formats.

Traditionally for qPCR, the reaction wells in the plate are utilized so that a single plate has multiple samples and standards analyzed by one or a few target assays. Additional target assays are performed on additional plates primarily due to the large number of wells required for the standards. It is desirable to prepare reaction mixtures as partial pre-mixes to minimize the number and complexity of dispensing steps performed because these steps are most often done by manual pipetting. In the traditional format, the premix is prepared with all but the sample nucleic acids and dispensed into the portion(s) of the plate designated for that target assay. Each sample nucleic acid, up to 96 different ones per plate, is then individually dispensed into pre-assigned wells for the analysis.

There are two major disadvantages to this dispensing system. First, each sample is diluted into every reaction premix well for every target assay, thereby introducing multiple sample dilution errors both within sample replicates and across target assays. Because qPCR measures concentration in each reaction well, with the dispensed volumes of both the premix and the sample contributing to the total variance, there is the potential to increase the level of variation in data and significantly influence the relative concentration results. Second, this strategy requires that when multiple samples are analyzed, they all must be available for analysis at the same time. In other words, samples originating at different times must be stored until an appropriate number have been obtained to fill the capacity of the microtiter plate. Since an appropriate sample number is typically 10 to 100, an investigator is not afforded the opportunity to evaluate initial data early in the sample collection phase to determine whether there are problems with this process.

Recently a new qPCR plate utilization system has become popular that eliminates these disadvantages. This system utilizes the same basic approach as high density microarrays wherein a single sample is applied once to a large number of target assays arrayed on a single reaction platform, in this case the PCR plate. In this qPCR array format, the target-specific assay reagents, i.e. the PCR primers, are pre-dispensed individually into their assigned reaction wells on the PCR plate and dried into the bottom of the reaction wells. The nucleic acid from a single sample is diluted once into a reagent pre-mix containing all other components necessary for qPCR, thereby using only a single dilution step for all the assays. This uniformly diluted pre-mix with sample is dispensed into all the wells on the plate by repetitive pipetting utilizing a multi-channel pipette. Thus, the user has only one sample solution to dispense over an entire plate and can analyze a single sample for up to about 84 target assays on a single 96-well microtiter plate. Dispensing of the one sample across the entire plate can be viewed as the analogy of applying a single coat of paint color across a surface.

This latter format can be enhanced by the use of 384-well plates (24×16 well configuration) to consolidate four different 96-well array formats into a single higher throughput run. From a plate management perspective for dispensing the target specific primers, it may be easiest to divide the 384-well plate into four registers of 96-wells by alternating rows and columns on the 384-well plate (see FIG. 1 for well assignment map). This well assignment structure, while still compatible with standard 8- or 12-channel pipettors, requires the user to keep track of alternating well positions for each sample throughout the dispensing process. In keeping with the painting analogy, dispensing each register of wells represents one color and, as in painting, therefore masking to prevent incorrect application of color over a specified area can be desirable. Alternate formats of the masks can be envisioned, specifically sets of masks for the 384-well plates can also accommodate 8 subsections of 48 wells, 12 subsections of 32 wells, 16 subsections of 24 wells, 24 subsections of 16 wells, or 32 subsections of 12 wells. Also for 96-well plates, sets of masks can accommodate 2 subsections of 48 wells, 3 subsections of 32 wells, 4 subsections of 24 wells or 8 subsections of 12 wells.

The multiwell devices with which the mask(s) of the invention can be used can have spatial arrays corresponding to those of standard microtiter plates, such as E-well, 12-well, 24-well, 96-well, 384-well, or 1536-well microtiter plates in the Society for Biomolecular Screening (SBS) format or other formats commonly used in the industry. See, e.g., Journal of Biomolecular Screening, Vol. 6, No. 2, 2001, p. 61-68. Thus, the multiwell devices may be, and advantageously are, compatible with conventional microtiter plate-related products, such as microtiter plate readers and microtiter plate robotic systems. The present invention facilitates use of multilevel array systems that can be used in high-throughput screening (HTS), in the study of protein-protein interaction, cell based assays, colorimetric assays and other known biological or non-biological assays, as well as in many other low volume assay methods.

There is a need in the art for equipment which reduces the potential for errors and facilitates adding materials to receptacles such as microtiter plates or other multiwell plates for carrying out immunoassays, ligand binding assays, toxicity tests, inhibitor testing and PCR assays, especially qPCR assays.

The present inventors have solved this problem by creating a set of plate covers with openings (masks) such that each mask masks the wells for the three sample registers that are not in use for the current round of pre-mix dispensing. Each plate mask effectively converts a 384-well plate into a 96-well plate for that round of pre-mix dispensing. While the description of use for the set of plate masks described herein uses the example of qPCR, these masks could be used with SBS microtiter plates suitable for other applications such as cell culture, immunoassays, colorimetric assays, toxicity testing, as well as on higher density plates, such as the 1536-well format.

The need to reduce potential operator error with respect to dispensing into microtiter plates has been recognized and has led to the development of several devices, some of which are patented (See, for example, U.S. Pat. Nos. 4,919,894, 5,290,521 and 7,597,854). Prior efforts to decrease the likelihood of manual dispensing errors using microtiter plates have employed apparatus that are designed for many uses on many plates and which involve mechanical movable parts. Development of such apparatuses represents increasing complexity which, while providing advantages, also adds to the cost and complexity of manufacture and use. Use of the same apparatus with multiple microtiter plates present risk of cross-contamination between plates. In all assays such cross-contamination can be hard to detect and can compromise the validity of assay results. In the case of highly sensitive assays with high dynamic range such as those based on amplification, including PCR, this problem is accentuated. While it is possible to employ these apparatus only once or to thoroughly decontaminate the apparatus between uses, this approach imposes significant cost to the user. These apparatuses require that the positioning of a guide be changed between additions, and they do not provide for tactile or other feedback to the operator to provide confirmation of completion of addition of reagent to a set of wells. Provided herein is a solution that is simpler to manufacture and use, and which may provide feedback to the operator during use and owing to the simplicity of its manufacture, may be provided at a cost that makes single disposable use economically practical.

Commercially available devices, currently include the computer based devices WellAware™ from BioTX Automation, Inc. (Conroe, Tex., US; see the internet at biotx.net) and LightOne™ Illuminator FS from Embi Tec (San Diego, Calif., US; see the internet at embitec.com), the mechanically complex WellMark® (U.S. Pat. No. 7,597,854) from Stovall Life Sciences, Inc. (Greensboro, N.C., US, and the sliding base and lid set called WellMatch from Gene Company Limited, (Hong Kong; see the internet at genehk.com). Additionally, none of these devices others of which the inventors are aware provide pipetting-action positive feedback of the addition of reagent to specific wells as described in some modes herein.

BRIEF SUMMARY

Provided is a set of masks, optionally formed of thin plastic, that fit snugly in only one orientation over the microtiter plate on which they are to be used. In an embodiment, there are cut corners in a particular orientation on each plate that mediate alignment. Other modes of mediating alignment can be used, for example, a printed, molded or stamped character, alignment peg or raised dot, notch or other physical indicator or combination of indicators to signify the intended orientation. In certain embodiments there are 4 masks comprised within a set for use together, sequentially allowing access to a registers of ¼ of the wells on the plate. More broadly, the set of masks fits on the multiwell receptacle so as to align holes in the mask with wells in the receptacle there under such than more than one and fewer than all of the wells in the receptacle are available for loading of material through the openings in the mask. More preferred is a set of masks such that the sum of all the holes in all the masks is equal to the number of holes in the receptacle and each hole occurs in only one mask of the set. More preferred is a set of masks in which the number of holes in each mask is the same. In another mode the set can be used in duplicated sets of masks to make multiple sequential additions to the wells on a plate. The above preferred embodiments may not always be optimal for a particular use, and alternative configurations may be preferred in specific assay formats.

Each mask has openings aligning with and providing access to wells in one of the subsections (typically registers or quadrants), in one mode defined by alternating rows and columns of the plate. In another mode the set of masks is composed of as many masks as there are predefined sections of wells on the plate. Each mask masks/blocks/protects wells that one does not want to accidentally add reagent or sample to during the particular stage of addition. Optionally, there can be a fragile, puncturable cellophane, paper, or elastomeric film which is punctured during sample addition, thereby helping the operator recognize the use status and dispensing step completion. In one mode the film emits a sound, such as a pop, upon penetration by the pipet providing audible as well as tactile confirmation of dispensing into specific wells. The use of each mask is simple, consisting of three simple steps, alignment of the mask with the multiwell receptacle, addition of reagents through holes in the mask, and removal of the mask. The present invention thereby eliminates the need for complexity associated with use of existing apparatus requiring the operator to perform fewer steps during use. Additionally the openings on the top of the mask may be marked to label the alphanumeric well position of the plate beneath the mask. In another mode the masks are made of colored transparent material allowing the user to confirm the proper alignment with the plate below before initiating pipetting.

Each mask is advantageously marked for register or quadrant identification; identification can be by way of color coding, with a different color indicating a particular sector or reagent or sample addition class, and numbers or other characters may be visible to facilitate proper reagent/sample addition order. In the case of color coding, the color of quadrants in a mask or different masks may be matched with the colors of containers of reagents to further help the operator add the correct reagent to the correct wells.

DETAILED DESCRIPTION

The masks described are designed to reduce errors and facilitate the dispensing of samples and/or reagents into a receptacle including, but not limited to, a microtiter plate. They are advantageous in that they are inexpensive to manufacture, easy to use and there is no additional equipment needed beyond the mask set.

Advantages of the masks of the invention are achieved when using consistently defined subsections of wells in a high throughput reaction plate that are established in alternating rows and columns such as those used for multiple samples. In another mode sections of wells may be in adjacent rows and columns. The present system of masks offers benefits in that dispensing sample and/or reagent into wells designated for other samples is carried out with greater accuracy. In another mode the masks aid in tracking/monitoring which wells have received their dispensed aliquot of reagent or sample. The masks, especially when in the form of a color-coded or otherwise distinguishable set, aid in keeping track of which samples have been added to the plate, and in addition, the mask or mask set aids in aligning multi-channel pipettes for dispensing properly into the multiwell plate below. Greater accuracy in setting up assays allows for improved data, greater confidence in test results and better economics as a result of the enhanced efficiency in terms of labor, reagents and equipment usage.

Figure 1:
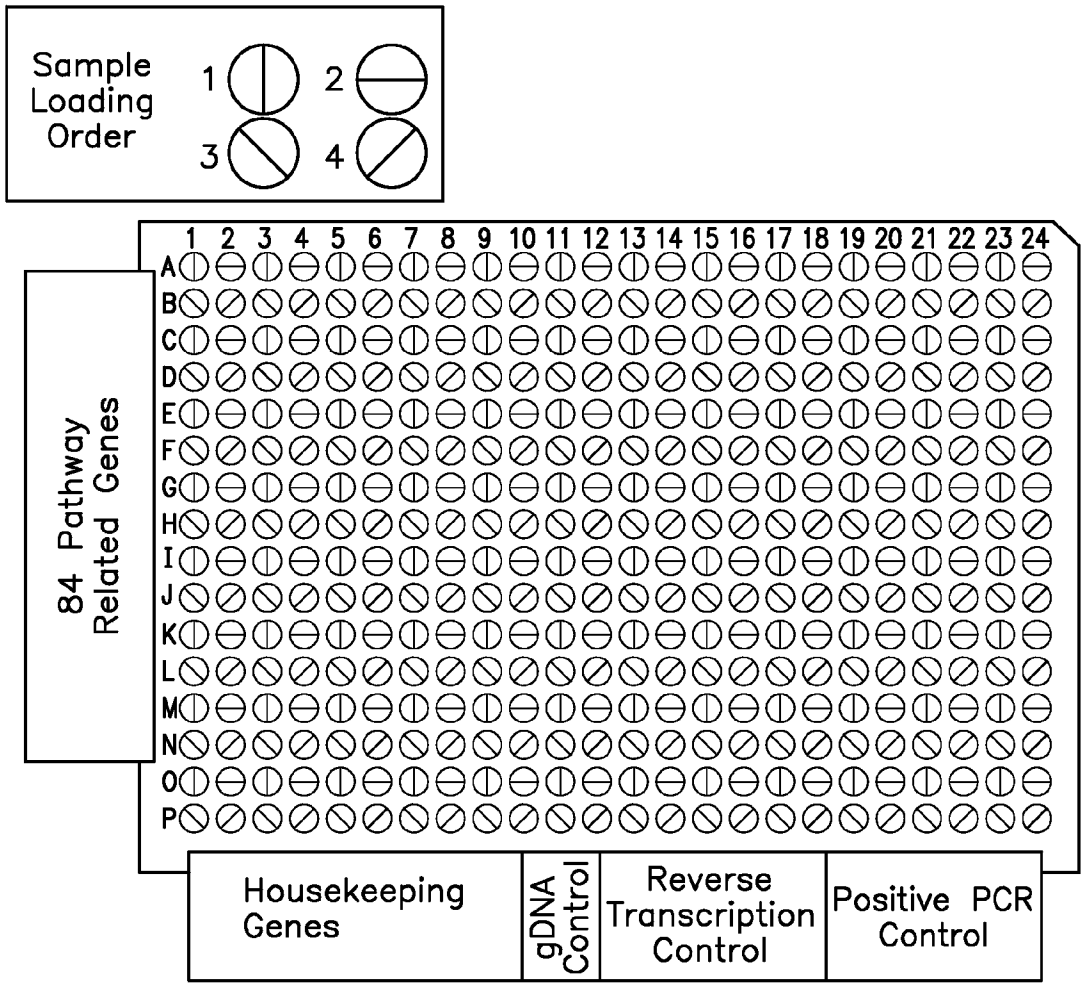
FIG. 1 shows the layout of a qPCR array, with coding of sample loading order at various positions: The positions for positions of assays for "housekeeping" genes; positive controls for the PCR reaction; and genomic DNA control and for reverse transcriptase control reaction positions. This figure shows the configuration of four 96-well arrays in alternating registers in one 384-well real-time PCR instrument microtiter plate. This drawing is a schematic, including generic well content (assays, i.e. containing particular dried down DNA primers in the wells) descriptions, for a Real-Time PCR Array products from SABioscience, Frederick, Md. The current exemplified system was developed to assist customers who are using this product. The "sample loading order" diagram shows the relative position of each subset of wells also called a register in the specification.
Figure 2:
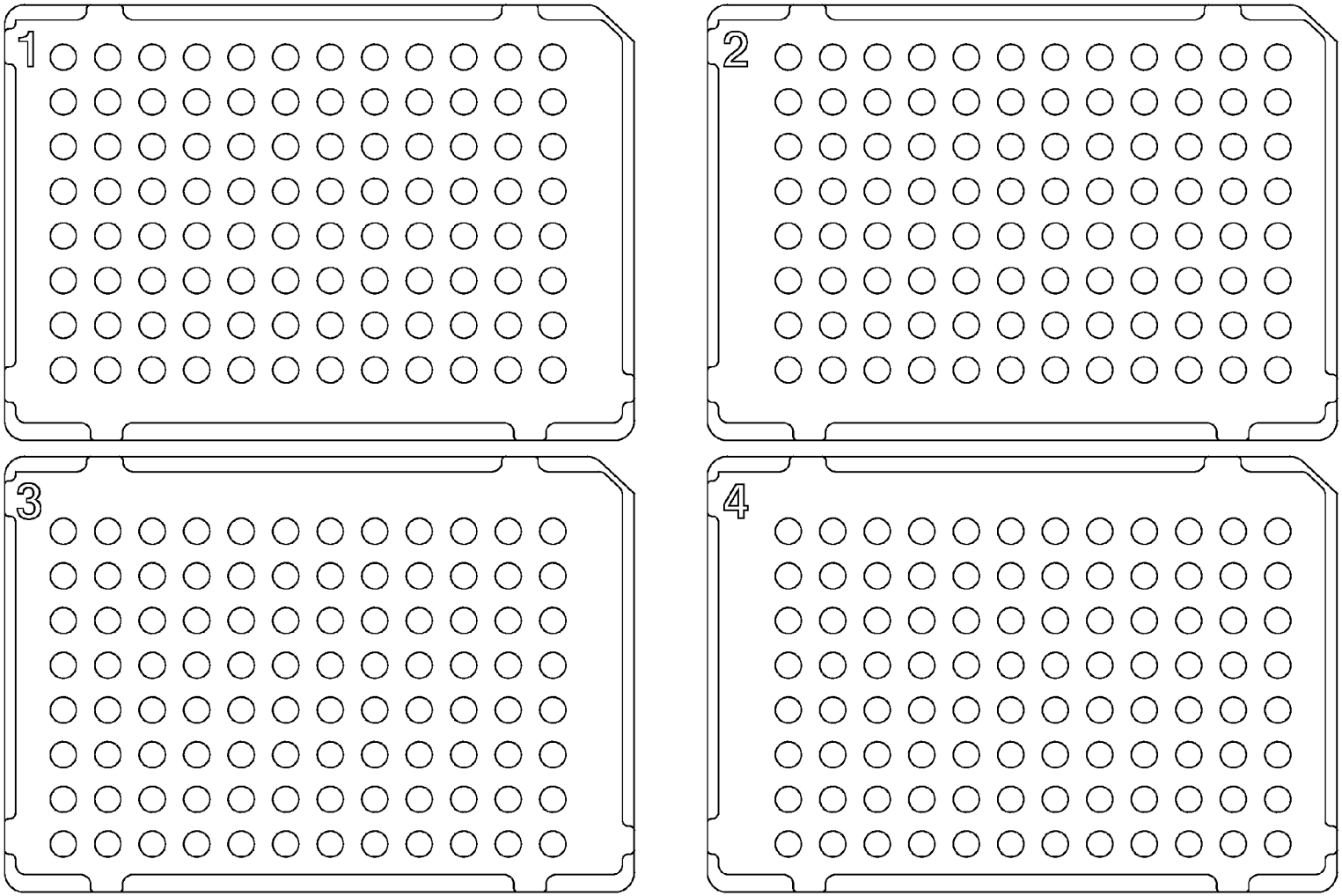
FIG. 2 shows, in top view, the four masks forming a set, with the positions of the openings aligned over wells within the microtiter plate in which reactions are carried out. Four colors of masks are used in a particular exemplary embodiment: white, yellow, black and red, each having a 12×8 array of openings, although other arrangements can be substituted. In particular embodiment, the order of use of the masks is given by numbers in the upper left corners of the masks, which may be molded during manufacture of the mask or printed subsequently. It is understood that other symbols (letters, shapes or the like) could be used to provide usage order. In a particular embodiment, the order symbols are formed during the molding process, but other ways of marking can be employed, such as printing or stamping or addition of an electronic or a computer-readable address. In addition, each well can be determined by identifiers, for example, as given above. In this embodiment, the set of four masks provides access to wells of alternating rows and columns. This is accomplished by offsetting the openings in each mask from the other three masks.
Figure 3:
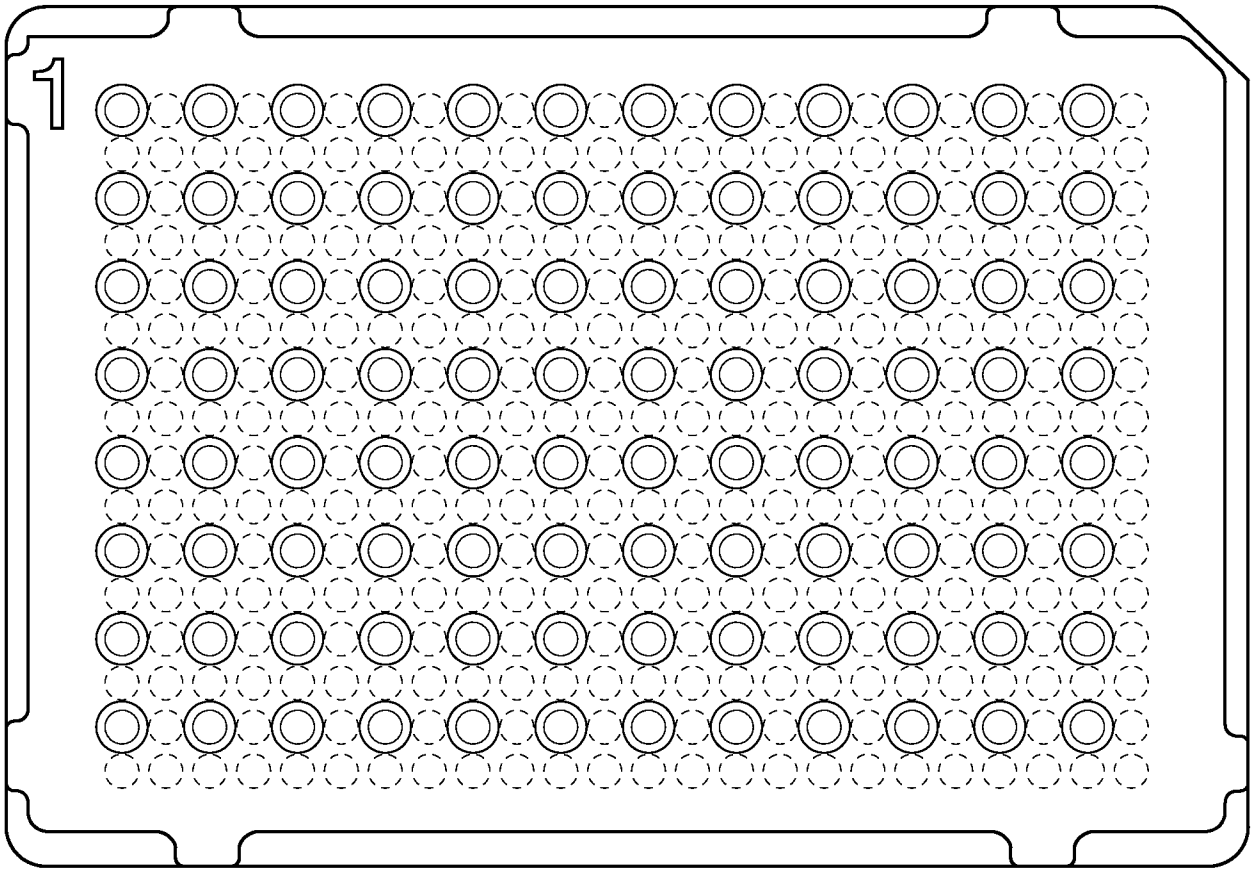
FIG. 3 provides diagrams for the layout of at least one mask of the present invention. The upper right corner is "cut" (angled) to enable the unique orientation over the microtiter plate of the same shape below. The microtiter plate wells accessible through the openings in the mask are shown. The dotted lines show the positions of the wells which are covered during the use of the particular mask shown in this diagram.
Figure 4:
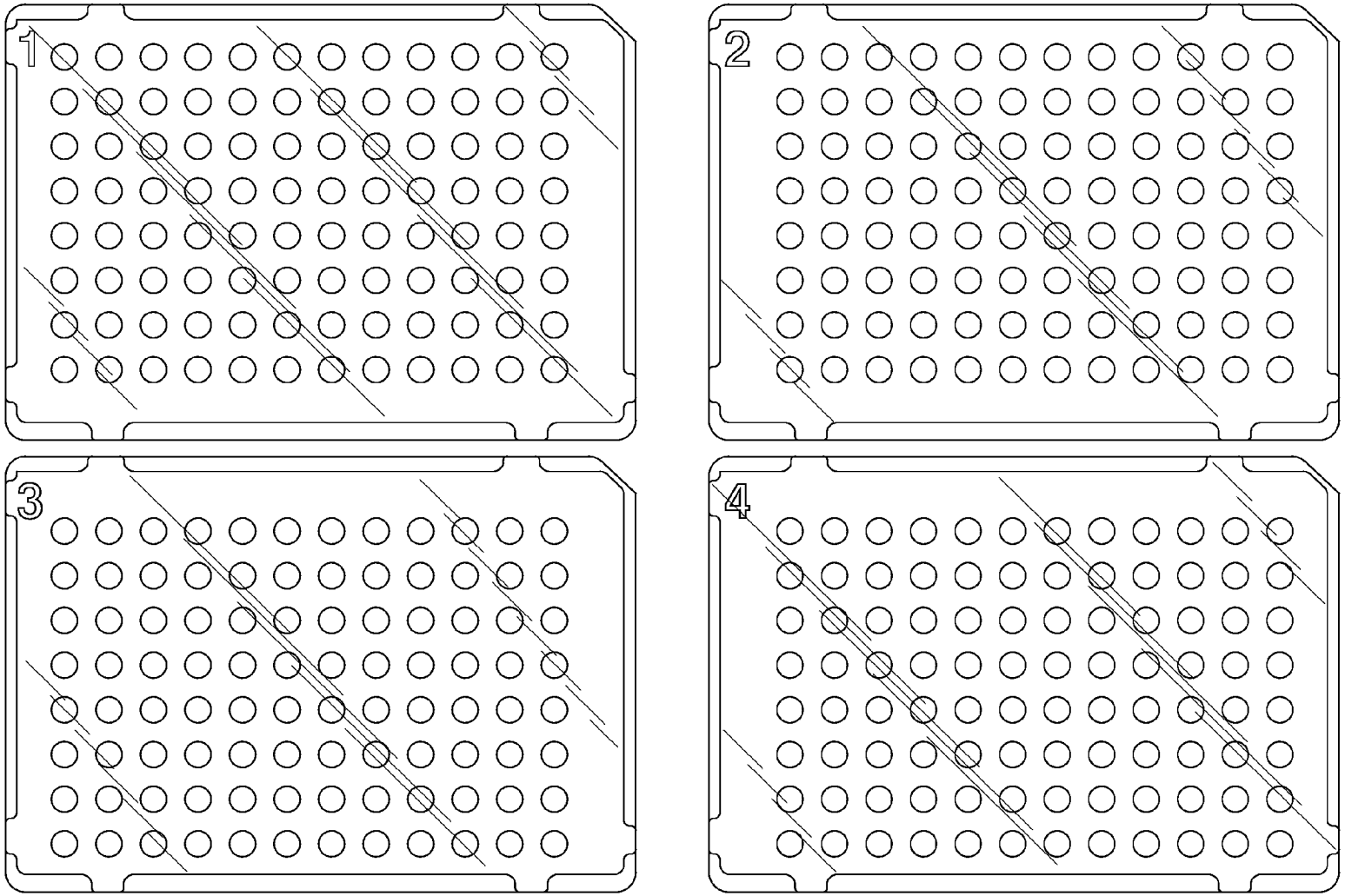
FIG. 4 shows the masks of FIG. 2, each covered by a film, as represented by diagonal lines.
Figure 5:
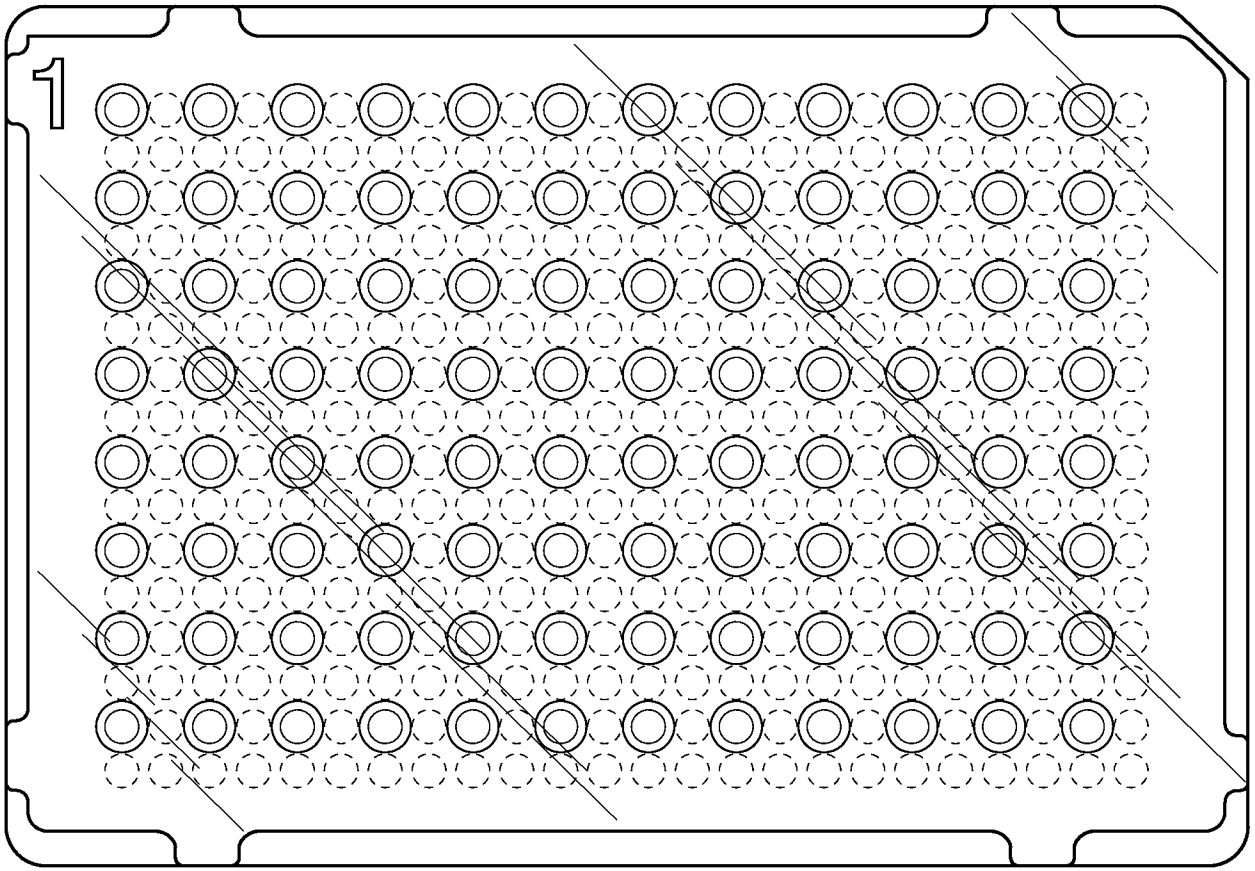
FIG. 5 shows the mask of FIG. 3, covered by a film, as represented by diagonal lines.

Provided are perforated microtiter plate covers (also termed masks herein), individually or preferably in a set, wherein each mask has a unique pattern of holes that permit access to a specific subset (typically a quadrant or register of alternating wells) of reaction wells on the plate (FIG. 2). The holes in the mask are of a size so that a pipette tip can access and fill the wells of the plate beneath the mask, and so that a multichannel pipettor can be used. Each mask prevents inadvertent addition of reagents to wells of a different register or section designated for other samples or reagents because they are physically blocked by the mask. In an embodiment, the set of masks render a 384-well plate into four 96-well registers (FIG. 3) allowing easier manual pipetting and sample tracking, as well as economy over the use of 4 separate 96-well plates. While the openings are shown as circular, other shapes can be used, provided that they are compatible with the wells beneath and with the sample or reagent delivery device.

Each mask is made so that it fits snugly on the microtiter plate, in only one orientation, most often guided by means of a single cut-off (angled) corner (and/or an alignment aid such as peg or visible marking such as a number) on the plate placed there by the plate manufacturer. Masks may be made of thin styrene plastic shaped by vacuum molding. They could also be made from other inexpensive materials including other plastics, cardboard or aluminum foil, with the methods of forming the shape and openings appropriate to the material, as well understood in the art.

Each mask is identifiable for its specific subset of wells through the use of easily identifiable markings such as color and/or numbers that allow the user to unambiguously know which mask is for which register or quadrant.

While the masks can be re-usable, especially when lacking the puncturable film over holes, they are preferably single use, disposable devices to avoid cross contamination from plate to plate during repeated use.

The masks allow the use of a 384-well plate as constituting four 96-well plates each available for use with a different sample. This is advantageous because most commonly available multichannel pipettors accommodate 96-well SBS well spacing intervals. In this form the wells for each 96-well plate are in alternating rows and columns of the larger plate so that the first well position for all four registers are adjacent to each other. The position of each register within the can be described as for quadrants on a compass so the register one is the northwest (NW) position, register two is the northeast (NE) position, register three is the southwest (SW) position and register four is the southeast (SE) position.

Advantageously, there is a registration mark (physical and/or visual) to help the user to properly align the mask or set of masks with the plate below. In addition, it is beneficial for the registration to be present on all masks within a set of masks. There may also be markings to denote the intended order of use within sets of masks.

An embodiment has the openings of the mask (mask) lined with a penetrable seal, which may be formed of a thin film or elastomeric material, penetration (puncture) of the film by pipet tips mark those wells that have already received a reagent or sample aliquot. In this form, the breach is visually apparent to the user. In addition the breach is tactile in that there is initial resistance before the breaking necessary for sample dispensation, which allows confirmation. With appropriate selection of the film material, the breach will produce a noise that will provide an audible report thereby providing confirmation of addition by three sensory modes.

Provided herein is a simple, inexpensive method of use that reduces the level of difficulty for manually dispensing multiple samples or reagents into a high throughput microtiter plate with improved accuracy. The method of use described herein involves only three steps, aligning the mask with the multiwell receptacle, adding reagent(s) and/or sample(s) to wells in the multiwell receptacle, and removing the mask. The second step, addition of the reagent, may also involve the puncturing of a film covering holes in the mask. By simplifying and reducing the difficulty of carrying out these operations, the risk of incorrect addition is reduced and the likelihood of valid results being obtained is increased. The simplicity of this method also increases the efficiency of adding reagents and/or samples to the wells of multiwall receptacles.

All references throughout this application, for example patents, patent publications and non-patent literature documents or other source materials; are incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although there are certain specifically disclosed embodiments and optional features, modification and variation of the concepts disclosed herein may be resorted to by those skilled in the art, and that such modifications and variations are considered to be within the scope of this invention as defined by the appended claims.

In general terms and phrases used herein have their art-recognized meaning, which can be found by reference to standard texts, journal references and contexts known to those skilled in the art.

All patents and publications referenced in the specification reflect the level of skill of those skilled in the art to which the invention pertains. References cited herein indicate the state of the art, in some cases as of their filing date, and it is intended that this information can be employed herein, if needed, to exclude (for example, to disclaim) specific embodiments that are in the prior art. For example, when a compound is claimed, it should be understood that compounds known in the prior art, including certain compounds disclosed in the references disclosed herein (particularly in referenced patent documents), are not intended to be included in the claim.

Although the description herein contains certain specific information, examples and information, these should not be construed as limiting the scope of the invention but as merely providing illustrations of some embodiments of the invention. Thus, the scope of the invention should be determined by the appended claims and their equivalents, rather than by any examples given.

One skilled in the art readily appreciates that the present invention is well adapted to carry out the objects and obtain the ends and advantages mentioned, as well as those inherent in the present invention. The methods, components, materials and dimensions described herein as currently representative of certain embodiments are provided as examples and are not intended as limitations on the scope of the invention. Changes therein and other uses which are encompassed within the spirit of the invention will occur to those skilled in the art, are included within the scope of the claims.

We claim:

1. A set of masks adapted for use with a multiwall receptacle, the set of masks comprising a plurality of masks, wherein openings in each mask of the set are adapted to provide direct access to and are aligned with at least a subset of wells on the multiwall receptacle, wherein the openings in each member of the set of masks are specific for a unique subset of wells on the multiwall receptacle, and wherein each mask comprises (i) a sample register of openings for the unique subset of wells specific to said mask, and (ii) coverings for the sample registers of openings of the other masks of the set of masks; and wherein each mask is configured to nest on top of one another.

2. The set of masks of claim 1, wherein the shape of each mask within the set has a feature that allows for unique alignment on top of the multiwall receptacle.

3. The set of masks of claim 1, wherein each mask in the set has a distinguishing feature for identification of the sample register, wherein the distinguishing feature is visual or tactile.

4. The set of masks of claim 3, wherein the distinguishing feature is visual.

5. The set of masks of claim 4, wherein the distinguishing feature is color coding.

6. The set of masks of claim 3, wherein the distinguishing feature of each mask is tactile.

7. The set of masks of claim 1, wherein the multiwell receptacle is a microtiter plate based on the SBS format.

8. The set of masks of claim 1, wherein at least one mask in said set comprises a fragile puncturable film covering holes within the mask.

9. The set of masks of claim 8, wherein the film covers holes in at least one mask but leaves the wells visually identifiable, and wherein dispensing through the film punctures the film and provides to an operator confirmation that a reagent has been added to a well.

10. The set of masks of claim 9, wherein the confirmation is visual, tactile or audible.

11. The set of masks of claim 1, wherein the multiwell receptacle is a microtiter plate based on the SBS format and comprises 96, 384, or 1536 wells.

12. The set of masks of claim 1, wherein the plurality of masks consists of four masks.

13. The set of masks of claim 12, wherein the multiwell receptacle comprises 384 wells.

14. The set of masks of claim 1, wherein each mask consists same number of openings.

* * * * *